United States Patent [19]

Luker

[11] Patent Number: 4,557,394

[45] Date of Patent: Dec. 10, 1985

[54] LOCK ARRANGEMENT FOR CLOSURES

[76] Inventor: Edward Luker, 5812 Twickingham Ct., Evansville, Ind. 47711

[21] Appl. No.: 633,289

[22] Filed: Jul. 23, 1984

[51] Int. Cl.[4] ..... B65D 41/04

[52] U.S. Cl. ..... 215/317; 215/330

[58] Field of Search ..... 215/317, 321, 330, 329

[56] References Cited

U.S. PATENT DOCUMENTS

| | | | |
|---|---|---|---|
| 2,172,544 | 9/1939 | Panter | 215/317 |
| 2,684,168 | 7/1954 | McGinnis | 215/330 |
| 2,914,206 | 11/1959 | Lowen | 215/329 X |
| 3,262,596 | 7/1966 | Zillmann | 215/329 X |
| 3,971,487 | 7/1976 | Montgomery | 215/216 |

FOREIGN PATENT DOCUMENTS

| | | | |
|---|---|---|---|
| 2306896 | 11/1976 | France | 215/330 |

*Primary Examiner*—Donald F. Norton

*Attorney, Agent, or Firm*—Fisher, Crampton, Groh and McGuire

[57] ABSTRACT

A lock arrangement for closures and containers in which the container has a radially extending flange below the threads on the neck of the container and the closure extends below the flange in the closed position of the closure and container. The flange is larger than the inside of the closure which is made of a material which is deformable and has a good memory so that the portion of the closure below the radially extending flange is deformed radially outwardly and returns to its original molded position after the closure has been applied to the container to form an undercut skirt portion affording axial closing pressure between the closure and container and resists unthreading of the closure from the container.

16 Claims, 4 Drawing Figures

LOCK ARRANGEMENT FOR CLOSURES

This invention relates to screw type closures for containers and in particular to closures of the type having means in addition to the mating threads to hold a closure in sealing engagement on the container.

With some forms of screw type closures, it is common to provide in addition to the threads, means such as an annular bead at the open end of the closure to engage complementary means such as an annular collar on the neck of the container in a manner to apply an axial force tending to hold the sealing surfaces on the closure and container in tight sealing engagement and also to resist any tendency of the closure to loosen or turn even slightly in an opening direction. This latter resistance is frequently referred to as a non-backoff system and such mating means of collars and flanges also are referred to as snap retention systems which add to the sealing force generated by the closure and container threads.

Proper operation of the snap retention system requires maintaining dimensions of the closure and container within narrow limits. However, as closure and container sizes increase in diameter, the problem of maintaining such close tolerances become even more difficult and costly to achieve.

It is an object of the invention to provide a closure and container in which application of the closure to the container deforms a skirt portion of the closure to form an undercut frictionally engaging a flange on the container to maintain axial closing force and to resist unthreading of the closure from the container.

A feature of this invention is to provide a closure made of a material which is deflectable, has a good memory tending to return it to its as molded condition so that when a closure is applied to a container, the skirt portion is temporarily deformed to form an undercut applying both an axial force and frictional resistance to turning movement of the closure relative to the container.

In accordance with the present invention, a container has a threaded neck with a radially extending flange portion formed below the threads. The neck receives a threaded closure which has a cylindrical skirt extending below the flange portion on the container when the threads are engaged with each other. The diameter of the skirt below the threads is less than the diameter of the flange so that the skirt is deflected outwardly temporarily upon threaded application of the closure to the container and immediately after application the skirt tends to return to its original molded position to form an undercut skirt portion acting with the flange to apply an axial closing force to the closure relative to the container and also to provide frictional engagement resisting turning movement tending to unthread the closure from the container.

A preferred embodiment of the invention is illustrated in the drawings in which.

Figure 1:
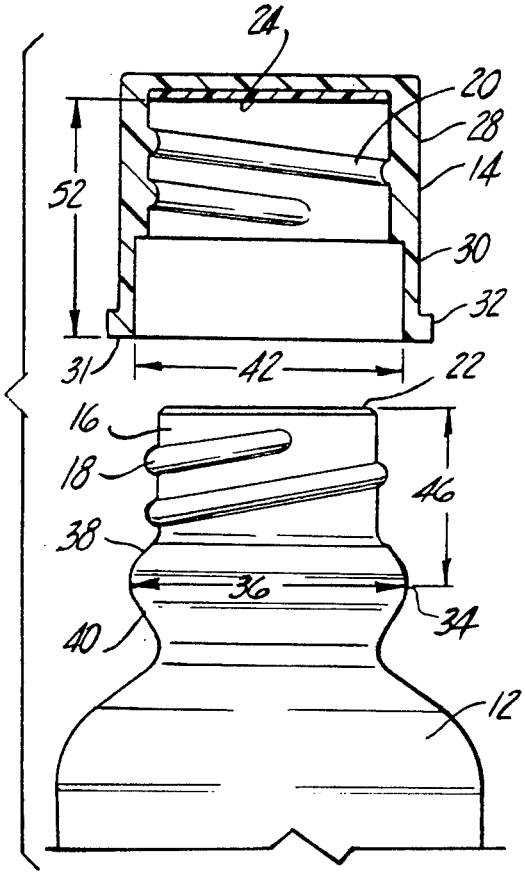
FIG. 1 is an exploded view of a closure shown in cross section and a container only a portion of which is shown.

The package embodying the invention is designated generally at 10 and includes a container 12 and a closure 14.

The container 12 can be in the form of a bottle having a neck 16 formed with external threads 18. The threads 18 are complementary to mating threads 20 formed within the closure 14.

The container 12 has a top sealing surface 22 around the opening in the neck 16 which in a normally closed condition of the package 10 is covered by a liner or seal 24 disposed within the cup shaped closure 14.

The closure 14 is generally cylindrical with a disc shaped top 26 and a cylindrical skirt 28. The cylindrical skirt 28 has a lower skirt portion 30 which has a slightly thinner wall section than the remainder of the skirt 28. The open end formed by the skirt portion 30 has a lip 31 and can be provided with an annular bead 32 which has a radial thickness greater than the thickness of the wall of the skirt portion 30 immediately adjacent to it.

The container 12 is provided with a flange portion 34 which preferably can be annular and continuous and is disposed below the threads 18. The flange portion 34 is dimensioned to have maximum diameter indicated at 36 from which the flange portion 34 slopes in opposite directions forming an upper surface 38 and a lower surface 40.

The inside diameter of the skirt portion 30 indicated at 42 in FIG. 1 is slightly less than the flange diameter indicated at 36 so that the skirt portion 30 will interfer with the flange 34 when the closure 14 is applied to the container 12.

Preferably, the closure 14 is made of a polymeric or copolymeric plastic material by conventional injection molding techniques. The material is such that it has a good memory when strained within its elastic limit over a short period of time but is substantially permanently deformable under load over a long period of time. For example, the closure 14 could be made of materials such as polyproylene which has such characteristics. Other possibilities are polyethylenes, non-rigid PVC and other non-rigid plastic materials. The container 14 on the otherhand, can be made of various materials such as glass, metal and plastics, the only preference being that the annular flange portion 34 be of more rigid construction then the cylindrical skirt portion 30 of the closure 14.

Figure 2:
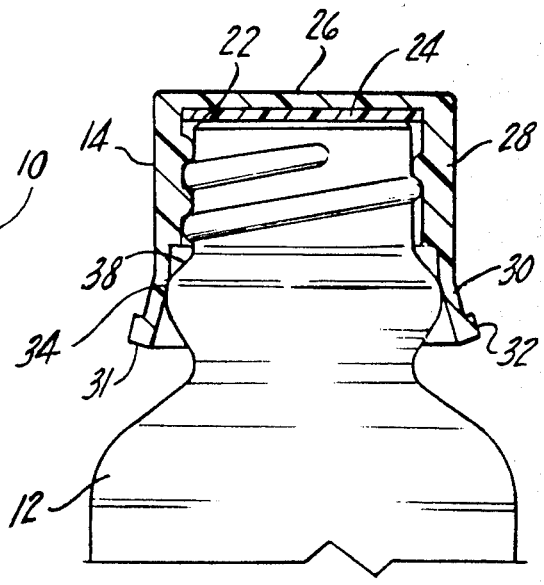
FIG. 2 is a view showing the condition of a closure at the instant that it is applied to a container.
Figure 3:
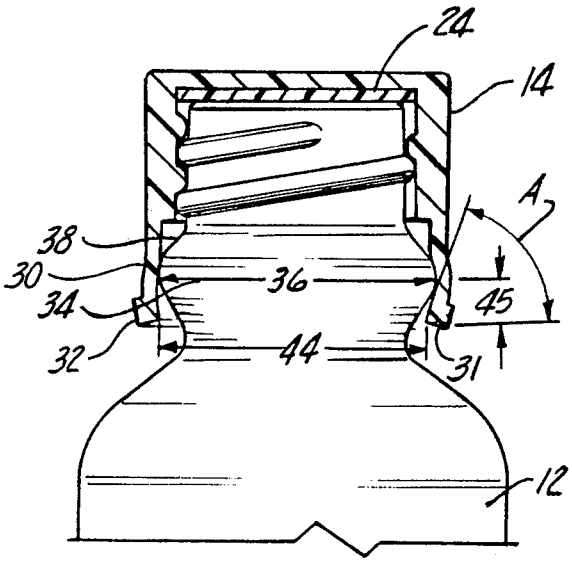
FIG. 3 is a cross-sectional view showing the closure after it has been applied to a container and the portions having returned toward their molded condition.

Upon application of the closure 14 to the container 12, the threading in a closing direction causes the skirt portion 30 to first engage the upper sloped surface 38 of the flange 34 and to subsequently deflect as the closure 14 moves downwardly on the neck 16. Such downward axial movement of the closure 14 continues until the liner 24 comes into engagement with the sealing surface 22 on the neck 16 of the container 12 at which time the annular bead 32 on the closure 14 will have been deflected outwardly and will assume the position illustrated in FIG. 2 at the instant after application of the closure 14 to the container 12. Immediately thereafter, the memory of the materials used in making the closure 14 will cause the annular bead 32 to return toward its as-molded condition in which, as illustrated in FIG. 3, the diameter of the opening indicated at 44 will be substantially equal to the inside diameter 42 of the skirt portion 30. This causes the lowermost portion of the skirt portion 30 to form an undercut angle A with a plane transverse to the axis of closure 14 whose tangent can be described as the axial dimension '45 between the maximum diameter 36 of the flange 34 and lip 31 as indicated in FIG. 3 divided by one half the difference between the dimension 36 and the dimension 44. This undercut results in an axial force between the container 12 and the closure 14 tending to squeeze the liner 24 into sealing engagement between the sealing surface 22 and the underside of the disc top 26. Such a force also presses the skirt portion 30 at the maximum diameter of the flange 34 into frictional engagement with the container to cause a frictional resistance which resists loosening of the closure 14 on the container 12. This feature is sometimes referred to as a "non-backoff" or NBO feature.

The present arrangement permits using closures 14 with an axial dimension 52 between the liner 24 and the lip 32 which varies over a considerable range. Moreover, such closures 14 can be used with container 12 in which the axial dimension 46 between the sealing surface 22 and the maximum diameter 36 of flange 34 varies substantially. It is only necessary that the axial dimension 52 of the closure 14 exceeds the dimension 46 of the neck 16 of the container 12.

During opening movement of the package, the closure 14 is unthreaded from the container 12 which causes the undercut skirt portion adjacent to the lip 31 to be deformed as it passes over the maximum diameter 36 of the flange 34.

In some closures of large diameter, it is extremely difficult to maintain the various diametrical dimensions of the closure and the container within the very close limits that are required and which are more readily attainable with small closure sizes. For example, in arrangements having small closure diameters of less than 1.5 inches, variations in closure diameters of plus or minus 0.005 inches is permissible and for the container, variations in diameter of plus or minus 0.010 inches are acceptable. With closures of larger diameter in excess of 2.5 inches, the closure can have a variation of plus or minus 0.007 inches and the container a plus or minus 0.017 inches.

Figure 4:
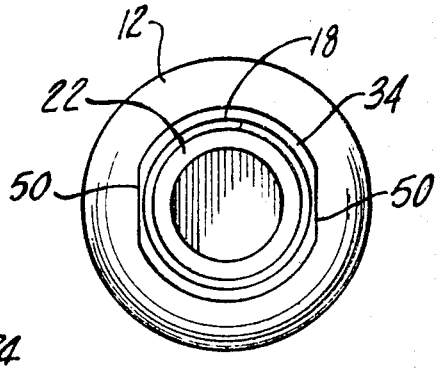
FIG. 4 is a top view of a container such as seen in FIG. 1 but with a modified flange portion.

It is necessary that there is an interference between the inner surfaces of the lower skirt portion 30 of the closure 14 and the outer circumference of the flange 34 when the largest allowable closure 14 is fit on the smallest allowable container 12. Consequently, it may be difficult, if not impossible, to place the smallest allowable closure 14 on the biggest allowable container 12 because the inside circumferential wall of the lower skirt portion 30 cannot expand sufficiently for the lip 31 to pass over the flange portion 34. For that purpose, a container 12, and particularly, the flange portion 34, is modified as best seen in FIG. 4. This is accomplished by forming one or more flat portions 50 on the chord of the circle describing the circumference at the maximum diameter 36 of the flange portion 34. The flat chord portions 50 reduce the circumference or perimeter of the flange portion 34 so that the lip 31 on the closure 14 is not required to stretch as much as with containers in which the flange portion 34 is completely annular. Even if the internal wall of the closure 14 at the lip 31 is equal to or slightly more than the perimeter of the modified flange portion 34, the closure 14 has substantially the same relationship to the container 12 as in the version described in FIGS. 1 through 3 in that an undercut portion described by the angle A will be formed by the closure at the flange portions to either side of a flat portion 50 to exert a radial downward force on the closure 14 to hold the liner 24 in sealing engagement with the sealing surface 22 of the container 12. Moreover, the closure skirt 30 will go "out of round" and provide additional resistance to rotation of the closure relative to the container.

I claim:

1. A lock arrangement for a closure and container comprising: a container having a threaded neck, an annular flange portion disposed below said threaded neck, a closure having a cylindrical skirt with an upper portion containing threads complementary to the threads on said neck and a lower thinner cylindrical skirt portion extending below said flange portion when said threads are engaged and said closure is in a closed condition on said container, said lower cylindrical skirt portion having a diameter less than the diameter of said radially extending flange portion on said neck, said lower skirt portion being deflectable outwardly temporarily upon threaded application of said closure on said container to a closed position, said cap being made of a resilient material having a good memory but being substantially permanently deformable under load over a long period of time whereby said lower skirt portion below said flange portion returns towards its original as molded position after closing of said container while said flange maintains the adjacent portion of said lower skirt portion extended radially outward to form an undercut skirt portion resisting axial opening displacement and rotational movement of said closure relative to said container.

2. The closure and container of claim 1 wherein said flange portion is a continuous annular flange on said neck of said container.

3. The closure and container of claim 1 wherein said flange portion is more rigid than the skirt of said closure.

4. The closure and container of claim 1 wherein said lower skirt portion has a lip formed at its lower edge and wherein said lip is radially thicker than said skirt adjacent to said flange.

5. The closure and container of claim 4 wherein said lip extends radially outwardly from said skirt.

6. The closure and container of claim 1 wherein said closure is made of a polymeric plastic material.

7. The closure and container of claim 1 wherein said annular flange has an upper sloping surface engageable with the lower portion of said cylindrical skirt to urge said skirt radially outwardly.

8. The closure and container of claim 1 wherein said flange has its maximum diameter spaced from the top of said container at a location axially less than the axial extent of said lower skirt portion.

9. The closure and container of claim 1 wherein said flange has its maximum diameter at a location spaced axially from said sealing surface a distance less than the axial extent of said lower skirt portion.

10. A package including a container and closure in threaded engagement with each other comprising: a container having a threaded neck, a sealing surface surround the opening in said neck, an annular flange on said neck disposed below said threads, a closure having a skirt with an upper portion with threads complementary to the threads on said container, a sealing surface formed on the underside of said closure and held in engagement with said sealing surface on said container when said threads are in engagement with each other, said skirt having a lower thinner portion with a diameter less than said flange for interference with said flange, said lower skirt portion forming an opened end defining a lip, said lip being disposed below and axially spaced from said flange when said sealing surfaces are in engagement with each other, said closure being made of a material being deformable under load but having a good memory whereby after said closure has been applied to said container, said lip returning toward its original as molded position while said flange maintains said lower skirt portion extended radially to form an undercut skirt portion resisting axial movement and rotation of said closure relative to said container.

11. The closure and container of claim 10 wherein said lower skirt portion forms an undercut portion having an angle with a plane transverse to the axis of the closure whose tangent is the axial dimension between the maximum diameter of said flange and said lip divided by one-half of the difference between the maximum diameter of said flange and the inside diameter of said skirt below said flange.

12. The closure and container of claim 10 wherein said lip is radially thicker than said lower skirt portion adjacent to said flange.

13. The closure and container of claim 10 wherein said annular flange has an upper sloping surface engageable with said lip to urge said skirt radially outwardly during closing movement of said closure relative to said container.

14. The closure and container of claim 10 wherein said annular flange has a removed chord portion reducing the perimeter of said flange portion at its maximum diameter.

15. The closure and container of claim 14 wherein said annular flange has a second removed chord portion diametrically opposed to said first mentioned removed chord portion.

16. The closure and container of claim 10 wherein said flange has a perimeter less than the circumference defined by the maximum diametric dimension of said flange portion.

* * * * *